US005177986A

United States Patent [19]

Jensen

[11] Patent Number: 5,177,986

[45] Date of Patent: Jan. 12, 1993

[54] LOCKABLE TIE STRAP

[76] Inventor: Wayne P. Jensen, 1143 Privet St., San Diego, Calif. 92069

[21] Appl. No.: 583,812

[22] Filed: Sep. 17, 1990

[51] Int. Cl.[5] ..... E05B 73/00

[52] U.S. Cl. ..... 70/18; 70/58

[58] Field of Search ..... 70/18, 14, 15, 16, 17, 70/30, 49, 57, 58, 233

[56] References Cited

U.S. PATENT DOCUMENTS

| | | | |
|---|---|---|---|
| 490,537 | 1/1893 | Bremer | 70/18 |
| 2,324,183 | 7/1943 | Wilson | 70/16 |
| 4,003,228 | 1/1977 | Lievens | 70/58 |
| 4,185,361 | 1/1980 | Stuart | 70/18 |
| 4,261,493 | 4/1981 | Newman | 70/58 |
| 4,325,238 | 4/1982 | Scherbing | 70/18 |

FOREIGN PATENT DOCUMENTS

| | | | |
|---|---|---|---|
| 97388 | 1/1923 | Switzerland | 70/15 |

*Primary Examiner*—Alexander Grosz
*Assistant Examiner*—Suzanne L. Dino
*Attorney, Agent, or Firm*—Thomas J. Tighe

[57] ABSTRACT

A belt-like device for securing one object to another object, e.g. skis, snowboards, skateboards, bicycles, and the like to fixed poles to prevent theft. Two joined and closed loops are formed by the device, a first loop capturing a first object and the second loop capturing the second object tethering them together. The device has a line of flexible, strong material with a slip buckle. An end of the line remote from the slip buckle is passed through the buckle to form a noose. The noose is made to either encircle a first object or pass through an opening defined by the first object, either way capturing it. The second loop can be formed by joining an opening defined by the line remote from the noose to at least one other opening defined by the line between the noose and the remote opening. The second loop can be closed by a shackle passing through the joined openings, preferably the shackle of a lock. The lock can be secured to the belt and the belt can be worn around a person's waist when not being used to tether objects.

6 Claims, 2 Drawing Sheets

LOCKABLE TIE STRAP

This invention relates in general to adjustable, loop forming, lockable straps and the like used for securing movable objects to fixed anchors, such as permanent posts and rails, to protect the objects from being carried off by persons not authorized to do so by the respective owners of the objects.

BACKGROUND OF THE INVENTION

The prior art presents cables and chains and the like. They are used by passing them through a captured opening in the object to be protected and wrapping them around an anchoring bar. The ends are then locked together by means of a padlock linking eyelets at the ends, or by means of joining a male half of a lock affixed to one end and a female half of the lock affixed to the other end. These prior art devices cannot be used unless there exists in the protected object a confined opening through which they can pass. Skis and ski poles typically have no such openings.

There exist devices to lock skis and poles to a fixed anchor but they are bulky and not safely transportable by a person while skiing. This particularly becomes a problem when there exists multiple ski lodges distant from each that a skier wishes to visit. For example, there may be a ski lodge at the base of a mountain and one at the top of a mountain. If a skier rides a ski lift and carries a prior art locking device to the top of the mountain to secure his or her skis while visiting the upper lodge, the rigidity and bulkiness of the prior art devices make it unsafe for the skier carry the device downhill while skiing. Thus at the base of the mountain the skier has no means to secure the skis.

Two very significant advantages of this invention over the prior art are that this invention can protect objects from thieves even though the objects, such as skis, do not have confined openings, and further, that this invention can be safely and attractively transported by a person even while skiing. It is worn about the waist as a colorful decorative belt, but when removed it can function as a relatively unbreakable locking device.

Other advantages and attributes will be readily discernible upon a reading of the text hereinafter.

SUMMARY OF THE INVENTION

This invention presents a device for lockingly tieing a moveable object to a fixed bar, such as a post or a rail comprising a line of flexible material, means for making a noose with the line, the noose being used to secure the object to the line, means for both preventing the noose from becoming loosened and for lockingly closing a portion of the line outside the noose around the fixed bar to secure the line to the bar. In one embodiment the invention has an elongated, flexible strap and a slip buckle affixed to one end of the strap for creating a noose whenever the end of the strap remote from the slip buckle is drawn through the slip buckle, the size of the noose being proportional to the amount of strap drawn through the slip buckle, the noose being used to capture the object or alternately the fixed bar. An opening defined by the strap at the end of the strap remote from the slip buckle and a plurality of openings spaced along the strap are used for the purpose of selectively limiting the maximum size of the noose in order to keep the thing captured by the noose captured and for the purpose of closing the free end of the strap means back upon the strap means in order to capture the bar means or alternatively, respectively, the object. A locking means having a shackle is used to lockingly link the opening at the end of the strap means remote from the slip buckle with a selected one of the plurality of openings spaced along the strap which is outside of the noose, the locking means being too large to pass through the slip buckle.

An object of this invention is to provide a lockable strap means which is easily and conveniently transportable by being worn about the waist of a person as a belt, but which functions as a relatively unbreakable means for securing a transportable object to a fixed bar, such as a post or rail.

A further object of this invention is to prevent casual thievery of transportable property and to make it necessary that a thief perform more difficult and more noticeable actions, such as using cable or bolt cutters and other instruments, in order to take away transportable property secured by this invention.

Other objects of this invention will either be expressly discussed hereinafter or will be clear from a reading of the text.

DESCRIPTION OF THE PREFERRED EMBODIMENT

Figure 1:
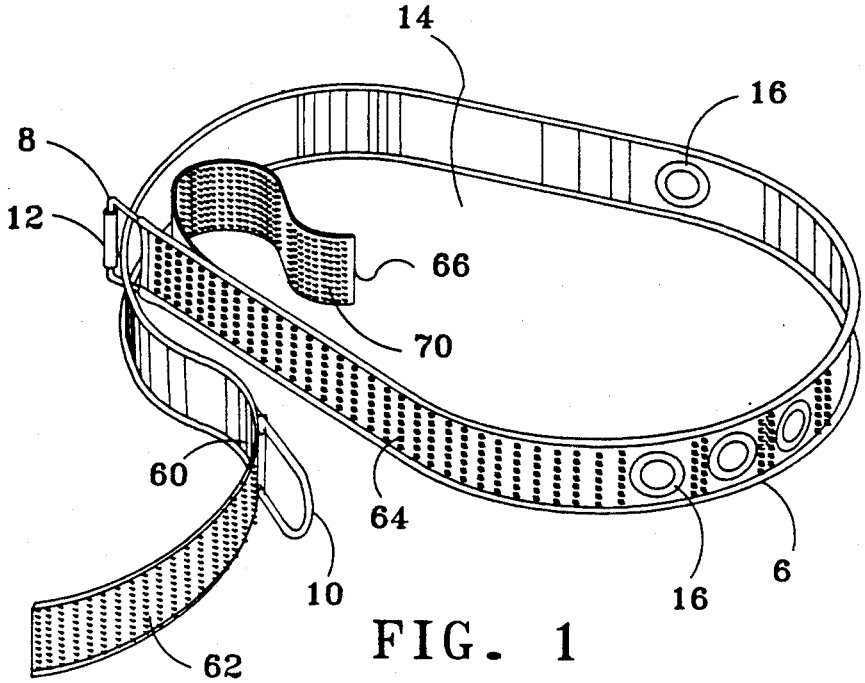
FIG. 1 is a pictorial view of the invention
Figure 4:
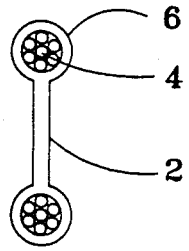
FIG. 4 is a sectional view taken along lines 4—4 of FIG. 2.

FIGS. 1–4 illustrate an embodiment of this invention in the form of a narrow strip of flexible material, i.e. a strap. A web 2 of the strap comprises a durable and strong fabric, such as durable nylon and the like. A length of relatively unbreakable, but flexible cable 4 circumscribes the web in a closed loop. Along the sides, i.e., the long edges, of the web lengths of the cable extend through and are disposed in marginal hems 6 of the web. The cable extends from hem to hem at and beyond the ends of the web forming at one end a slip buckle 8, and forming a U-shaped loop 10 at the other end.

Referring to FIGS. 1–4 again, the cable loop forming the slip buckle 8 is flattened and reinforced by a stiffening sleeve 12. The flattened loop permits easier passage therethrough of the strap. As will be further explained, by passing the opposite end of the strap through the slip buckle, a noose 14 is formed (as illustrated in FIG. 1) which closes tighter as more of the strap is drawn through the slip buckle.

The cable can be a steel cable material such as the kind commonly used in bicycle locking cables. By relatively unbreakable, as used herein, is meant that the length cannot be cut except by use of special steel cutting instruments which exert great cutting force. This invention will, of course, not prevent a determined thief with special cutting instruments from taking an object secured by this invention, but it will prevent more casual thievery, and it will force a thief to perform obtrusive acts in order to accomplish his or her purpose.

Referring to FIGS. 1–4 again, suitably spaced along the strap are grommets 16. As will be further explained, the grommets provide a means for fixing the size of a noose 14.

Figure 5:
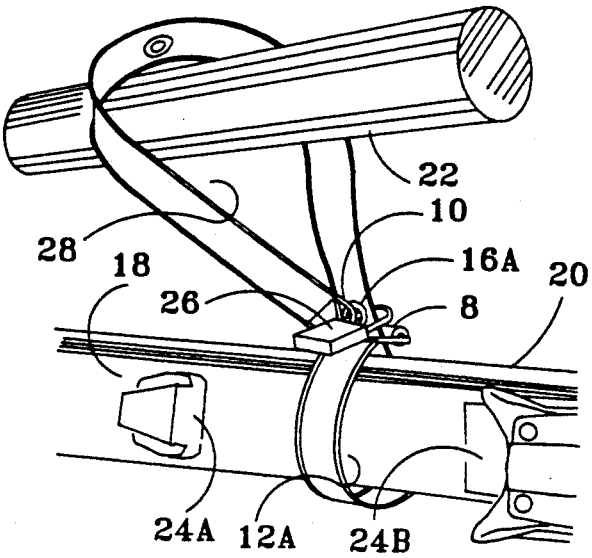
FIG. 5 is a pictorial view of the invention securing a pair of skis and ski poles to a fixed rail.

Referring to FIG. 5, an example of the invention in use is illustrated. It is being used to tie a pair of skis 18 and poles 20 to a fixed rail 22. In this use, a noose 12A was created by passing the end of the strap opposite the slip buckle 8 through the slip buckle. The skis and poles were either inserted through the noose or the noose was created around them between front and back portions of a ski boot bindings, 24A and 24B. The noose was tightened to at least a size too small for either portion of the boot bindings to pass through. The loose portion of the strap was wrapped around the fixed rail and the opening defined by the U-shaped cable loop 10 was made to register with a grommet 16A, and the shackle of a padlock 26 was inserted through both openings and locked. The padlock shackle not only closes and locks the strap loop 28 which is around the rail, but it also prevents the slip buckle from traveling further along the strap noose which would have the effect of loosening the noose 12A. This is because the slip buckle opening is suitably sized to permit the strap to pass therethrough but not the padlock. Grommet 16A was chosen to keep the noose tight enough to keep either portion of the ski boot bindings from passing therethrough, thus capturing the skis and poles in the noose.

Figure 6:
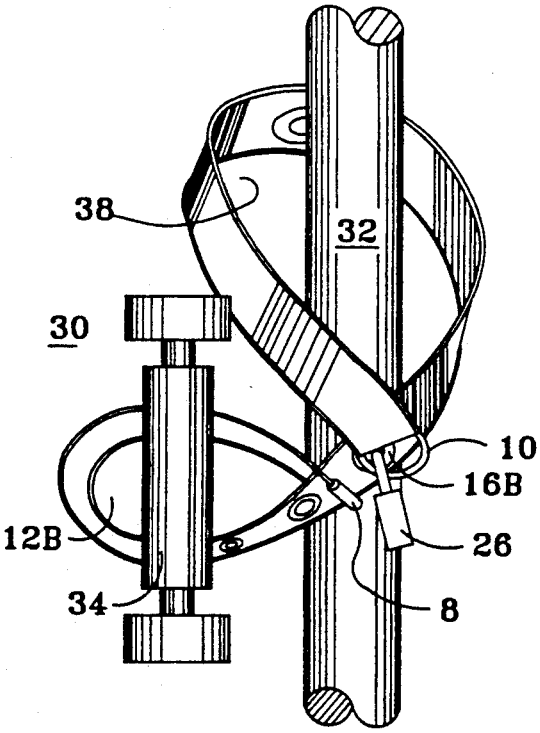
FIG. 6 is a pictorial view of the invention securing a skate board to a fixed post.
Figure 8:
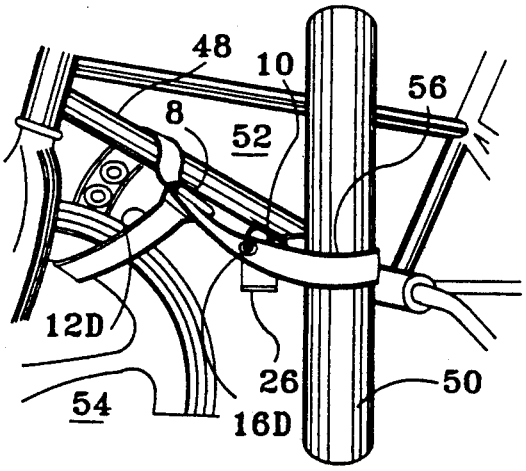
FIG. 8 is a pictorial view of the invention securing a bicycle to a fixed rail.

Referring to FIG. 6, another example of the invention in use is illustrated. It is being used to secure a skate board 30 to a fixed pole or post 32. As in the previous example, a noose 12B is created by passing the end of the strap opposite the slip buckle 8 through the slip buckle. The noose was made to capture a stem portion (not shown) of a truck 34. (The stem portion affixes the truck to the board and the truck carries the wheels.) The capture was made by tightening the noose to a size too small to permit passage therethrough of the truck. As before, the loose portion of the strap was wrapped around a fixed bar, in this case a fixed vertical post, and the opening defined by the U-shaped cable loop 10 was made to register with a grommet 16B, and the shackle of a padlock 26 was inserted through both openings and locked. The padlock shackle not only closes and locks the strap loop 38 which is around the post, but it also prevents the slip buckle from traveling further along the strap noose which would have the effect of loosening the noose 12B. Grommet 16B was chosen because it was suitably disposed on the strap. Restraining the slip buckle at the point of grommet 16B is sufficient to keep the noose tight enough around the truck stem to maintain capture of the truck and thereby the skate board.

Figure 7:
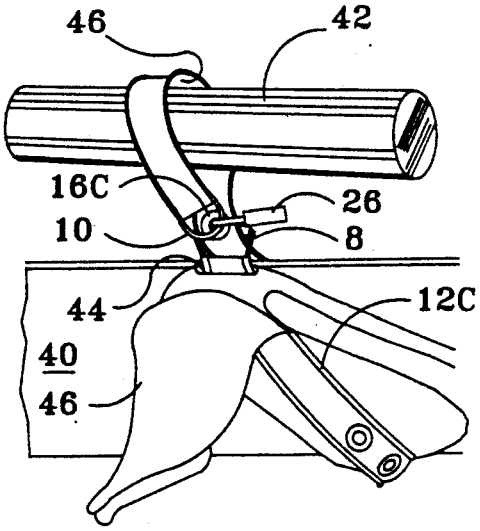
FIG. 7 is a pictorial view of the invention securing a snow board to a fixed rail.

Referring to FIG. 7, another example of the invention in use is illustrated. It is being used to secure a snow board 40 to a fixed rail 42. As in the previous examples, a noose 12C is created but there are two significant differences. In this example the strap was passed through a confined opening 44 in a boot binding 46 that is affixed to the snow board before the noose is created, i.e., closed. In this way the snow board was captured by the noose, but not by the tightness of the noose, rather by the fact that noose is a closed loop which extends through a confined opening 44. As before, the loose portion of the strap was wrapped around a fixed bar, in this case a fixed rail, and the opening defined by the U-shaped cable loop 10 was made to register with a grommet 16C, and the shackle of a padlock 26 was inserted through both openings and locked. Grommet 16C was chosen because it was beyond the noose and therefore it was usable to accomplish closure of the loop 46 around the rail, closure being accomplished, as likewise in the other examples, by the linking of the U-shaped loop 10 with the grommet 16C by the padlock shackle.

Referring to FIG. 7, another example of the invention in use is illustrated. It is being used to secure a bicycle 48 to a fixed post 50. In this example, the strap was passed through two confined openings before the closed noose 12D was created. It was passed through a confined opening 52 in the frame in order to secure the frame to the post, and it was passed through a confined opening 54 in the front wheel to secure the front wheel also. (Thieves often detach wheels of chained bicycles if they are unable to steal the entire bicycle.) In this way both the bicycle frame and a bicycle wheel were captured by the noose, but not by the tightness of the noose, rather by the fact that noose is a closed loop which extends through the confined openings, 52 and 54. As before, the loose portion of the strap was wrapped around a fixed bar, in this case a fixed post, and the opening defined by the U-shaped cable loop 10 was made to register with a grommet 16D, and the shackle of a padlock 26 was inserted through both openings and locked. Grommet 16D was chosen because it was beyond the noose and therefore it was usable to accomplish closure of the loop 56 around the post, closure being accomplished, as likewise in the other examples, by the linking of the U-shaped loop 10 with the grommet 16D by the padlock 26 shackle.

While the above examples show a noose capturing the protected object and the free end of the strap being wrapped around a post or a rail and locked to a grommet, it should be understood that alternatively the free end need not be wrapped around anything if the thing to which the object is being anchored has a grommet or grommet-like confined opening to which the U-shaped loop can be locked. For example, the noose could be made to capture a part of a jet ski while the free end could be locked to an eyelet anchored in a dock piling by registering the U-shaped loop with the eyelet and locking the shackle of the padlock through both.

It should also be noted that this invention can be used in a manner somewhat reverse to the uses described above. The noose 14 can be used to capture a fixed bar (e.g. post or rail), and the free end of the strap can be used to capture the object to be protected. The free end can loop through a confined opening with the U-shaped loop being locked to a suitable grommet, or the U-shaped loop can be locked to a grommet or grommet equivalent defined by the object.

Referring to FIGS. 1–4 and 8, additional features of this invention are illustrated. A tongue of fabric 60 is affixed to the web 2 at the U-shaped loop 10 end of the strap. The fabric tongue extends in a line with the strap and on a first side has an area of fastener hooks 62 which mates with an area of fastener loops 64 on a facing surface of the web proximate the slip buckle 8. The hook and loop fastener areas are so disposed and are of such extents that they face each other to allow a person to wrap the strap around his or her waist passing the end of the strap opposite the slip buckle 8 through the slip buckle. The hook and loop fastener areas permit the person to tighten the noose around his or her waist and secure it in that tightened position by mating, i.e., pushing together, the hook and loop fastener areas. Wearing the strap around one's waist is an easy way for one to carry this invention without inconvenience. For example, a skier can carry this invention about his or her waist, and thereby carry the means to lock up his or her skis, in a way which does not interfere with the activity of skiing.

Figure 9:
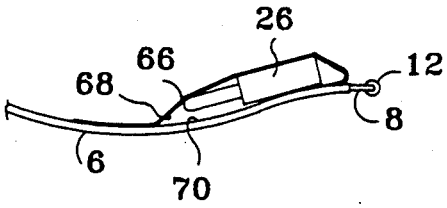
FIG. 9 is a partial edge view showing means by which a lock means is attached.
Figure 2:
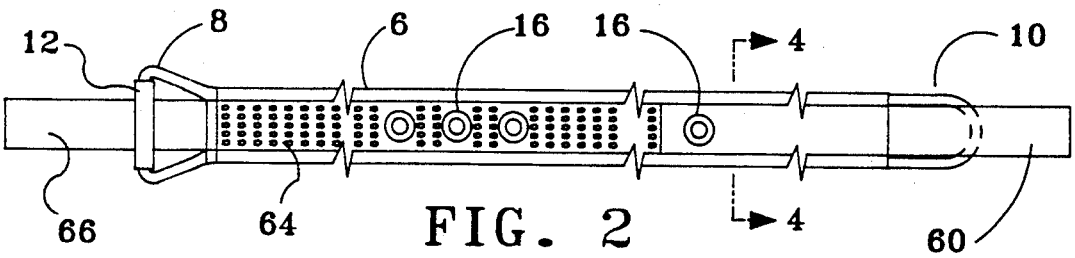
FIG. 2 is a plan view of a first broad side of the invention.
Figure 3:
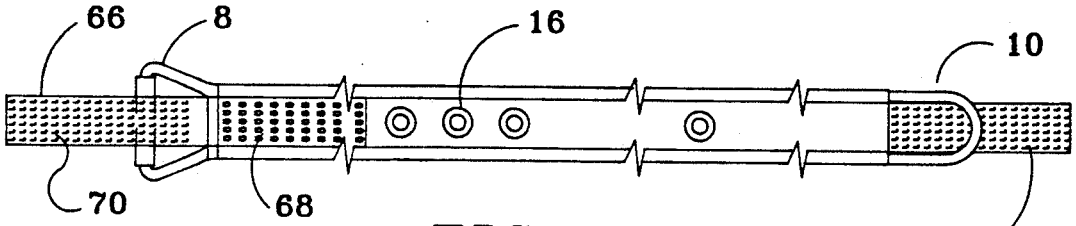
FIG. 3 is a plan view of a second broad side of the other side of the invention.

Referring to FIG. 9, a fabric tongue 66 affixed to the slip buckle end of the strap provides a means for securing the padlock 26 to the strap on an inside of the strap, inside being the side facing a person's body when the person is wearing the strap about the person's waist as described hereinabove. Proximate the slip buckle and located on the inside of the strap is an area of fastener loop material 68 which is so disposed and sufficiently extends to mate with a fastener hook area 70 on the inside face of the fabric tongue 66. The padlock 26 has both broad sides covered with fastener hook or loop material. In operation the padlock is secured to the strap by sandwiching it between the strap and the folded back tongue 66 as illustrated in FIG. 9.

The foregoing description and drawings were given for illustrative purposes only, it being understood that the invention is not limited to the embodiments disclosed, but is intended to embrace any and all alternatives, equivalents, modifications and rearrangements of elements falling within the scope of the invention as defined by the following claims.

I claim:

1. A device for securing a first object to a second object comprising:

(a) a line of flexible material, (b) a slip buckle means affixed to one end of the line for creating a noose whenever an end of the line remote from the slip buckle means is drawn through the slip buckle means, the size of the noose being proportional to the amount of line drawn through the slip buckle means, the noose being used to capture the first object or alternately the second object, (c) a first aperture defined by the line remote from the noose, (d) at least one other aperture defined by the line intermediate the first aperture and the noose, and (e) means for lockingly linking said first aperture with a selected one of said at least one other aperture for capturing the second object or alternately, respectively, the first object, the means for lockingly linking being not passable through the slip buckle means.

2. The device according to claim 1 wherein the means for lockingly linking comprises a lock having a shackle which extends through said first aperture and the selected one of said at least one other aperture.

3. The device according to claim 2 further comprising means for securing the lock to the line for convenient transportation whenever the lock is not in use.

4. The device according to claim 3 wherein the means for securing the lock to the line comprises:

(a) a tongue of flexible material extending from the line sufficiently to embrace the lock against the line, and (b) means for securing the embrace.

5. The device according to claim 1 further comprising means for wearing the device around a person's waist.

6. The device according to claim 5 wherein the means for wearing the device around a person's waist comprises a tongue of flexible material extending from one end of the line sufficiently to overlap the other end of the line when the line is wrapped about the person's waist, and means for fastening the overlapping portion of the tongue to said other end of the line.

* * * * *